US005775520A

United States Patent [19]

Drower

[11] Patent Number: 5,775,520

[45] Date of Patent: Jul. 7, 1998

[54] STORAGE RACK WITH MODULAR PAIRS OF SUPPORT LOOPS MAINTAINING UNIFORM PRESSURE AGAINST THE ARTICLES

[75] Inventor: Herbert M. Drower, Wilmette, Ill.

[73] Assignee: Transilwrap Company, Inc., Chicago, Ill.

[21] Appl. No.: 728,748

[22] Filed: Oct. 11, 1996

[51] Int. Cl.[6] ..... A47F 5/00

[52] U.S. Cl. ..... 211/89.01; 211/120; 211/69.8

[58] Field of Search ..... 211/89.01, 70.6, 211/69.8, 120

[56] References Cited

U.S. PATENT DOCUMENTS

| | | | |
|---|---|---|---|
| 1,746,577 | 2/1930 | Berglund et al. | 211/120 X |
| 3,305,100 | 2/1967 | Barbee | 211/120 X |
| 4,936,469 | 6/1990 | Drower | 211/89.01 X |
| 5,419,443 | 5/1995 | Niederberger et al. | 211/89.01 X |
| 5,570,794 | 11/1996 | Drower | 211/89.01 |

*Primary Examiner*—Jose V. Chen

*Attorney, Agent, or Firm*—Dorn, McEachran, Jambor & Keating

[57] ABSTRACT

An elongated storage rack for supporting small articles and things. The storage rack includes an elongated support having a bracket receiving channel adapted to receive a number of brackets. An elongated bracket has arms located at opposite ends of and extending outwardly of the bracket. A pair of support loops are held in each bracket between the outwardly extending arms. Each pair of support loops is formed as a plastic strip having a pair of legs connected by a bight portion. One leg of each support loop is positioned contiguously relative to a similar leg of the other support loop of the pair. The other leg of a pair of support loops is positioned remotely of the similar leg of the other support loop of the pair. The remotely positioned legs of a pair of loops each have base portions attachable to the bracket. The contiguously positioned legs are mounted for slidable movement towards and away from each other to provide a uniform support pressure against a small article or thing positioned between the contiguously positioned legs.

15 Claims, 2 Drawing Sheets

STORAGE RACK WITH MODULAR PAIRS OF SUPPORT LOOPS MAINTAINING UNIFORM PRESSURE AGAINST THE ARTICLES

BACKGROUND OF THE INVENTION

Storage racks for small articles and things ranging from pencils and pens to other items such as paint brushes, cassettes, computer floppy disks and small containers are available in many sizes, styles, constructions and configurations. Previously known storage racks of this type do not effectively maintain a uniform holding pressure against small articles or things inserted between a pair of loops especially when the supported articles and things vary in thickness and weight or if a large number of articles are supported between various loops on the rack at one time. In such prior storage racks, the holding power of a pair of loops supporting an article was affected by the size and shapes of the articles being held by adjacent pairs of loops.

SUMMARY OF THE INVENTION

It is a principal object of the present invention, therefore, to provide a new and improved storage rack for small articles and things utilizing modular pairs of plastic loops in which each pair of loops provides a uniform holding pressure against an article or thing being supported regardless of its weight or thickness and independently of the other number of articles being held in the storage rack by other pairs of loops.

Another object of this invention is a storage rack having modular pairs of supporting loops with each pair of loops being mounted on a separate bracket which permits each pair of loops to function independently of the pairs of supporting loops mounted on other brackets.

An additional object of this invention is a storage rack having modular pairs of supporting loops with each pair of supporting loops being mounted on a separate bracket which is supported in the storage rack independently of the other brackets.

Yet another object of this invention are article supporting loops which are mounted on a bracket in a manner which permits their article engaging legs to slide apart to adjust for the thickness of the article being supported but resists pullout of the loops during such sliding movement.

Accordingly, the invention relates to an elongated storage rack for supporting small articles and things comprising an elongated support having a bracket receiving channel. One or more elongated brackets, each having a front face and arms located at opposite ends of the front face with the arms extending outwardly of the front face, are installed in the channel. A pair of support loops are mounted in each bracket between the outwardly extending arms. The pair of support loops in each bracket is formed of a strip of a tough, resilient, abrasive resistant resin. Each pair of support loops has a pair of legs connected by a bight portion which is positioned outwardly of the front face of the bracket. One leg of each support loop is positioned contiguously relative to a similar leg of the other support loop of the pair. The other leg of each of the support loops of a pair are positioned remotely of each other. The remotely positioned legs of each pair of loops each have base portions which are attached to the front face of the bracket. The contiguously positioned legs are mounted for sliding movement away from each other and towards the remotely positioned legs to maintain a uniform support pressure against an article or thing placed between a pair of support loops. The elongated support may be varied in length to receive a number of brackets to thereby vary the number of pairs of support loops in the storage rack

BRIEF DESCRIPTION OF THE DRAWINGS

The invention is illustrated more or less diagrammatically in the following drawings wherein.

DESCRIPTION OF THE PREFERRED EMBODIMENTS

Figures 1, 2, 3:
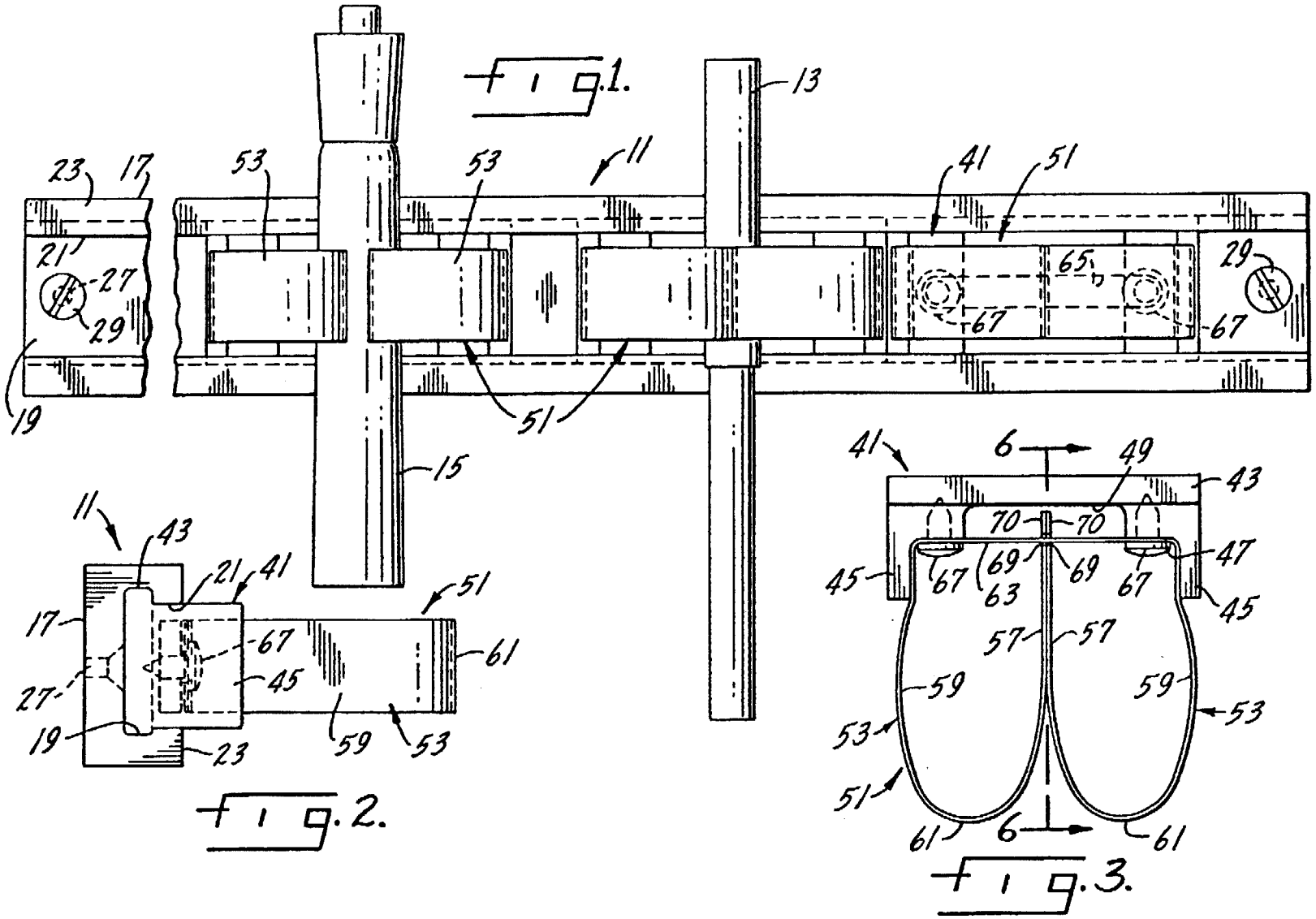
FIG. 1 is a front elevational view of a first embodiment of a storage rack constructed in accordance with the teachings of the present invention with some hidden parts shown in dashed lines and some parts broken away.
FIG. 2 is a side elevational view of the rack of FIG. 1 with some parts omitted and hidden parts shown in dashed lines.
FIG. 3 is a top plan view of a single bracket and pair of support loops of the type shown in FIG. 1.

FIGS. 1–6 of the drawings illustrate a first embodiment of this invention shown as an elongated storage rack 11 which is intended to be used for the storage of a variety of small articles and things of varying sizes, shapes and weights. Specifically, for purpose of illustration, and not by way of limitation, a pen 13 and a marker 15 are shown supported on the rack. It should be understood and appreciated that other articles, such as measuring tapes, chalk, putty knives, erasers, paint brushes, cassettes, computer floppy disks, etc., may be stored on such a rack.

The elongated storage rack 11 includes an elongated support 17 which may be formed of plastic or wood or other suitable material. A longitudinally extending channel 19 is formed in the elongated support with an opening 21 leading to the front face 23 of the elongated support thus forming the elongated support 17 with a transverse cross section of a somewhat C-shape as is most clearly shown in FIG. 2 of the drawings. Openings 27 may be formed in the elongated support extending from the channel 19 rearwardly for receiving screws 29 or other fasteners to attach the elongated support to a supporting wall or other surface not shown in the drawings. Of course, it should be understood and appreciated that in lieu of screws or other fasteners, the elongated support 17 may be attached to a supporting surface by suction cups, adhesives such as stick wax blocks, or double sided tape.

The elongated support 17 is dimensioned to receive a number of elongated brackets 41, for example, the three brackets shown in FIG. 1 of the drawings. Each bracket 41 may be formed of plastic or wood or other suitable material and includes a laterally enlarged base 43 which is adapted to fit into and engage the walls of the channel 19 of the elongated support 17 in the manner shown in FIG. 2 of the drawings. Forwardly extending arms 45 are formed integrally with the base 43 of the bracket at opposite ends thereof and extend outwardly beyond the front face 47 of the bracket. A recess 49 is formed in the front face 47 of the bracket and extends partially between the arms 45 as shown most clearly in FIG. 3 of the drawings. A pair 51 of support loops 53 is mounted in each bracket 41. Each pair of support loops is formed as a plastic strip 55. The plastic strip is a tough, resilient, abrasion resistant resin, preferably a polyester resin or a laminate. The preferred resin for the support loops is two layers of oriented polyethylene terephthalate laminated with a central layer of polyethylene, the same basic construction as is used in commercial identification cards and similar articles. The plastic strip is formed into the two support loops 53 with each support loop having a pair of legs 57 and 59 connected by a bight portion 61 which bight portions are positioned outwardly of the front face 47 of the bracket 49 as shown in FIGS. 1, 2 and 3 of the drawings.

Figures 4, 5, 6, 7, 8, 9:
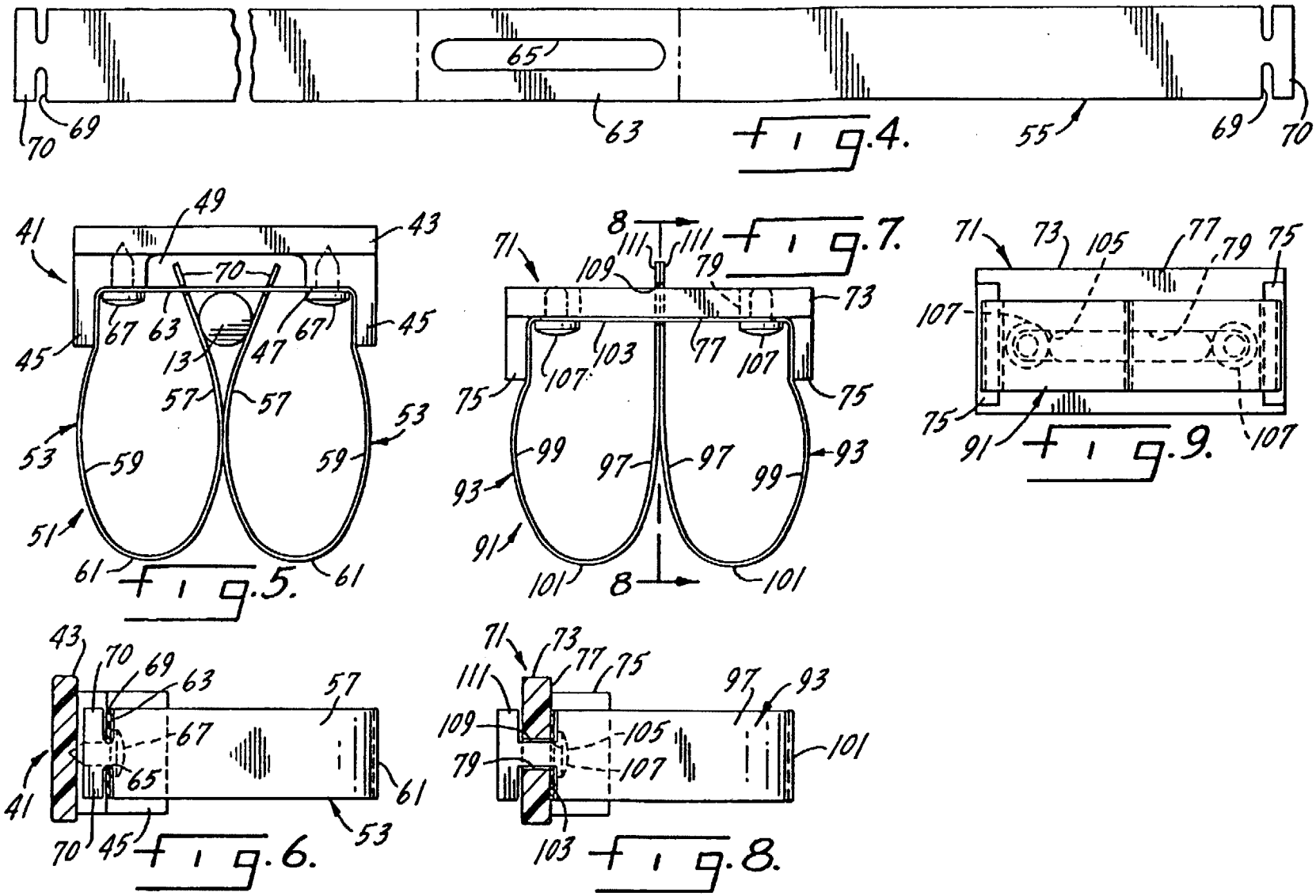
FIG. 4 is a partial plan view of a support loop of this invention shown in its flattened, outstretched condition.
FIG. 5 is a top plan view of the bracket and pair of support loops of FIG. 3 shown supporting a small article.
FIG. 6 is a cross sectional view taken along line 6—6 of FIG. 3.
FIG. 7 is a top plan view of a second embodiment of a support bracket and a pair of loops made in accordance with the teachings of the invention.
FIG. 8 is a cross sectional view taken along line 8—8 of FIG. 7.
FIG. 9 is a front elevational view of the bracket and loops of FIG. 7.

Each bracket 41 is supplied with a pair 51 of support loops 53 which are formed from the plastic strip 55 shown in its flattened extended form in FIG. 4 of the drawings. As can be seen most clearly in FIG. 3 of the drawings, each support loop is formed with legs 57 and 59 with legs 57 being contiguous and in contact with each other and legs 59 being located on the outward sides of the pair 51 of support loops 53. Each loop is also formed with a bight portion 61 and the legs 59 connect to a base 63 which is positioned against the front face 47 of the bracket 49. A slot 65, which extends through the plastic strip 55 as shown most clearly in FIG. 4 of the drawings, extends over the recess 49 of the front face of the bracket 41. Fasteners 67 are installed through the slot 65 adjacent the opposite ends thereof and into the front face 47 of the bracket to attach the support loops to the bracket.

The distal ends of the legs 57 of the loops 53 are notched at 69 to form tails 70 which can be inserted through the slot 65 by twisting to lock the distal ends of the legs 57 to the base 63 to permit the legs 57 to be forced apart from each other in the manner shown in FIG. 5 when an article to be supported, such as the pen 13, is positioned between the legs adjacent the base 63 of the pair of support loops.

A modified form of bracket 71 is shown in the second embodiment of the invention depicted in FIGS. 7, 8 and 9 of the drawings. The bracket 71 may be formed of the same materials as those recited for the bracket 41 previously described in the embodiment of FIGS. 1–6 of the drawings. The bracket includes an enlarged base 73 which is adapted to fit into and engage the walls of the channel 19 of the elongated support 17 in the same manner as shown and described for bracket 41 in FIG. 2 of the drawings. Forwardly extending arms 75 are formed integrally with the bracket at opposite ends thereof and extended outwardly beyond the front face 77 of the bracket. A slot 79 is formed to. extend through the front face 77 of the bracket. Its longitudinal extent is such that it terminates short of the arms 75 at opposite ends of the bracket.

Each modified bracket 71 is supplied with a pair 91 of support loops 93 which are formed from a plastic strip similar to plastic strip 55 shown in FIG. 4 of the drawings. Each support loop is formed with legs 97 and 99 with legs 97 being contiguous and in contact with each other and legs 99 being located on the outward sides of the pair 91 of support loops 93 as shown most clearly in FIG. 7 of the drawings. Each loop is also formed with a bight portion 101 and the legs 99 connect to a base 103 which is positioned against the front face 77 of the bracket 71. A slot 105, which extends through the base 103 of the support loops, is considerably longer than the slot 79 which is formed in the front face 77 of the bracket 71 as can be observed most clearly in FIG. 9 of the drawings. Fasteners 107 are installed through the slot 105 formed in the base 103 of the support loops outwardly of the slot 79 to attach the support loops to the front face of the bracket.

The distal ends of the legs 97 of the loops 93 are notched at 109 to form tails 111 which can be inserted through the slots 79 and 105 by twisting to lock the distal ends of the legs to the base 103 and the bracket 71 to permit the legs 97 to be moved apart from each other when an article to be supported is positioned between the legs.

I claim:

1. An elongated storage rack for supporting small articles and things, said rack including:

an elongated support having a bracket receiving channel, an elongated bracket having a front face and arms located at opposite ends of and extending outwardly of said front face, said elongated bracket formed and adapted to be received and supported in said bracket receiving channel with said arms extending outwardly of said elongated support, a pair of support loops positioned in said bracket between said outwardly extending arms, said pair of support loops formed as a plastic strip having pairs of legs each connected by a bight portion which are positioned outwardly of said front face of said bracket, one leg of each of said support loops positioned contiguously relative to and in contact with a similar leg of said other support loop of said pair and said other leg of each of said support loops positioned remotely of a similar leg of said other support loop of said pair;

said remotely positioned legs of said pair of loops each having base portions attached to said front face of said bracket, a guide formed in said base portions, at least one of said contiguously positioned legs of said pair of support loops being mounted in said guide for slidable movement away from said other contiguously positioned leg of said pair of support loops and toward the remotely positioned leg of its loop to provide and maintain a uniform pressure against a small article or thing placed between said contiguously positioned legs of said pair of loops, and fasteners to attach said base portions of said legs to said front face of said bracket.

2. The elongated rack of claim 1 in which each of said contiguously positioned legs of said pair of support legs are positioned contiguously relative to a similar leg of said other support loop of said pair and said other leg of each of said support loops is positioned remotely of a similar leg of said other support loop of said pair.

3. The elongated rack of claim 1 in which each of said contiguously positioned legs of said pair of support loops is positioned for slidable movement in said guide away from said other contiguously positioned leg of said other of said pair of support loops and towards the remotely positioned leg of its loop to provide a uniform support pressure against an object placed between said contiguously positioned legs of said pair of loops.

4. The elongated rack of claim 1 in which at least one of said contiguously positioned legs of said pair of support loops has a tail formed at its end, and said guide includes an elongated slot formed in said base portions between said remotely positioned legs and is formed and adapted to receive said tail of said contiguously positioned leg to guide said leg in such slidable movement.

5. The elongated rack of claim 4 in which each of said contiguously positioned legs of said pair of support loops has a tail formed at its end, and said guide includes an elongated slot formed in said base portions between said remotely positioned legs and is formed and adapted to receive said tails of said contiguously positioned legs to guide said legs in slidable movement.

6. The elongated storage rack of claim 5 in which said fasteners which attach said base portions of said legs to said front face of said bracket extend through said bracket.

7. The elongated rack of claim 5 in which an elongated passage is formed through said front face of said elongated bracket in alignment with said elongated slot in said base portion to receive said tails of said contiguously positioned legs to guide said legs in slidable movement.

8. The elongated rack of claim 4 in which said fasteners which attach said base portions of said legs to said front face of said bracket extend through said elongated slot.

9. An elongated bracket having a front face and arms located at opposite ends of and extending outwardly of said front face, said elongated bracket formed and adapted to be mounted on a supporting surface with said arms extending outwardly thereof, a pair of support loops positioned in said bracket between said outwardly extending arms, said pair of support loops formed as a plastic strip having pairs of legs each connected by a bight portion which are positioned outwardly of said front face of said bracket, one leg of each of said support loops positioned contiguously relative to a similar leg of said other support loop of said pair and said other leg of each of said support loops positioned remotely of a similar leg of said other support loop of said pair, said remotely positioned legs of said pair of loops each having base portions attached to said front face of said bracket, a guide formed in said base portions, at least one of said contiguously positioned legs of said pair of support loops being mounted in said guide for slidable movement away from said other contiguously positioned leg of said pair of support loops and toward the remotely positioned leg of its loop to provide and maintain a uniform pressure against a small article or thing positioned between said contiguously positioned legs of said pair of loops, and fasteners to attach said base portions of said legs to said front face of said bracket.

10. The elongated rack of claim 9 in which each of said contiguously positioned legs of said pair of support legs are positioned contiguously relative to a similar leg of said other support loop of said pair and said other leg of each of said support loops is positioned remotely of a similar leg of said other support loop of said pair.

11. The elongated rack of claim 9 in which each of said contiguously positioned legs of said pair of support loops is positioned for slidable movement in said guide away from said other contiguously positioned leg of said other of said pair of support loops and towards the remotely positioned leg of its loop to provide a uniform support pressure against an object placed between said contiguously positioned legs of said pair of loops.

12. The elongated rack of claim 9 in which at least one of said contiguously positioned legs of said pair of support loops has a tail formed at its end, and said guide includes an elongated slot formed in said base portions between said remotely positioned legs and is formed and adapted to receive said tail of said contiguously positioned leg to guide said leg in such slidable movement.

13. The elongated rack of claim 12 in which each of said contiguously positioned legs of said pair of support loops has a tail formed at its end, and said guide include an elongated slot, formed in said base portions between said remotely positioned legs and is formed and adapted to receive said tails of said contiguously positioned legs to guide said legs in slidable movement.

14. The elongated storage rack of claim 13 in which said fasteners which attach said base portions of said legs to said front face of said bracket extend through said bracket.

15. The elongated rack of claim 12 in which said fasteners which attach said base portions of said legs to said front face of said bracket extend through said elongated slot.

* * * * *